US006092998A

United States Patent [19]

Dexter et al.

[11] Patent Number: 6,092,998

[45] Date of Patent: Jul. 25, 2000

[54] PUMP FOR A PRESSURE WASHER

[75] Inventors: Shane Dexter, Humboldt; Johnny Leeper, Jackson; Burl Daniel Vallelenian, Pinson; Allen Palmer, Jackson; John Hardin, Medina, all of Tenn.

[73] Assignee: DeVilbiss Air Power Company, Jackson, Tenn.

[21] Appl. No.: 09/045,091

[22] Filed: Mar. 20, 1998

[51] Int. Cl.[7] ..... F04B 35/00

[52] U.S. Cl. ..... 417/360; 417/269

[58] Field of Search ..... 417/269, 360, 417/454, 539; 92/71

[56] References Cited

U.S. PATENT DOCUMENTS

| | | | |
|---|---|---|---|
| 2,849,958 | 9/1958 | Mitchell . | |
| 3,847,504 | 11/1974 | Martin . | |
| 3,975,990 | 8/1976 | Kraus | 92/57 |
| 4,272,224 | 6/1981 | Kabele . | |
| 4,456,439 | 6/1984 | Wolff | 417/454 |
| 4,583,921 | 4/1986 | Wolff et al. | 417/269 |
| 4,611,529 | 9/1986 | Stricker et al. . | |
| 4,684,330 | 8/1987 | Andersson et al. . | |
| 5,288,211 | 2/1994 | Fry | 417/312 |
| 5,494,414 | 2/1996 | Steinhart et al. . | |
| 5,653,584 | 8/1997 | Mazzucato et al. . | |
| 5,826,461 | 10/1998 | Kaywood et al. | 74/567 |
| 5,886,436 | 3/1999 | Schneider et al. | 310/89 |

OTHER PUBLICATIONS

Avallone, E. (ed.), Marks' Standard Handbook for Mechanical Engineers, pp. 6–36 through 6–38, 6–40, 6–173 Dec. 1987.

*Primary Examiner*—Timothy S. Thorpe
*Assistant Examiner*—David J. Torrente
*Attorney, Agent, or Firm*—MacMillan, Sobanski & Todd, LLC

[57] ABSTRACT

A pump for a pressure washer. The pump includes a cam housing, a piston assembly disposed within the cam housing, a rotary shaft assembly disposed within the cam housing, a journal plate attached to the cam housing, a head assembly attached to journal plate and valve assembly operatively connected to the head assembly. The rotary shaft assembly includes a cam shaft, a vertically-extending oil tube partially disposed within a central portion of the cam shaft, a cam threaded onto the cam shaft and a thrust washer positioned adjacent the threaded cam. The piston assembly includes a plurality of pistons, preferably three, in mating contact with the thrust washer. Each piston includes a piston spring cap at one end, a spring disposed over the piston and engaging the piston spring cap, and a seal retainer having a low pressure seal at one end and a high pressure seal at the other end. The seal retainer includes an opening between the low pressure seal and the high pressure seal such that fluid passing through the high pressure seal is captured by the low pressure seal for recycling back into the head assembly. The head assembly, in combination with the valve assembly, forms a castellated assembly of a plurality of towers, preferably three, one for each piston. Each tower includes a low pressure valve assembly and a high pressure valve assembly that act as check valves. The low pressure valve assembly allows intake water to flow from the journal plate to a castellated tower channel. The high pressure valve assembly allows water to flow from the channel to the outlet fitting. The pressure washer can be mounted in either the vertical or horizontal orientation.

16 Claims, 6 Drawing Sheets

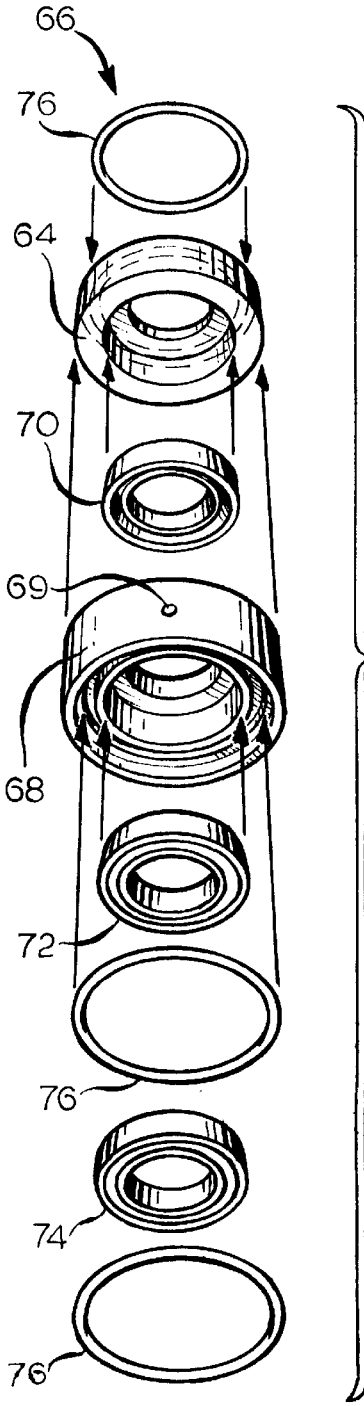
FIG. 2
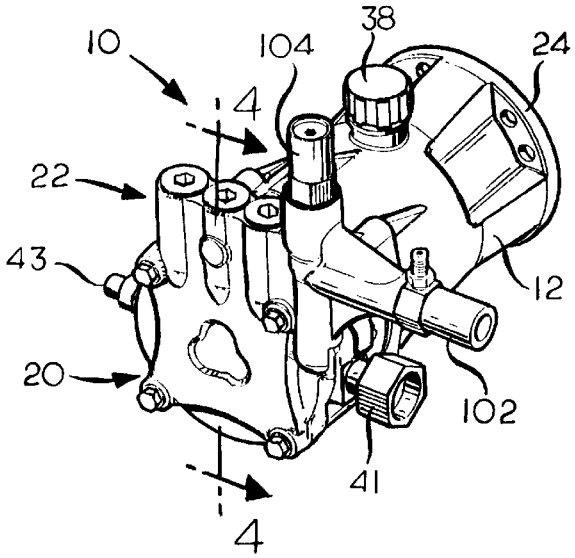
FIG. 1
FIG. 7
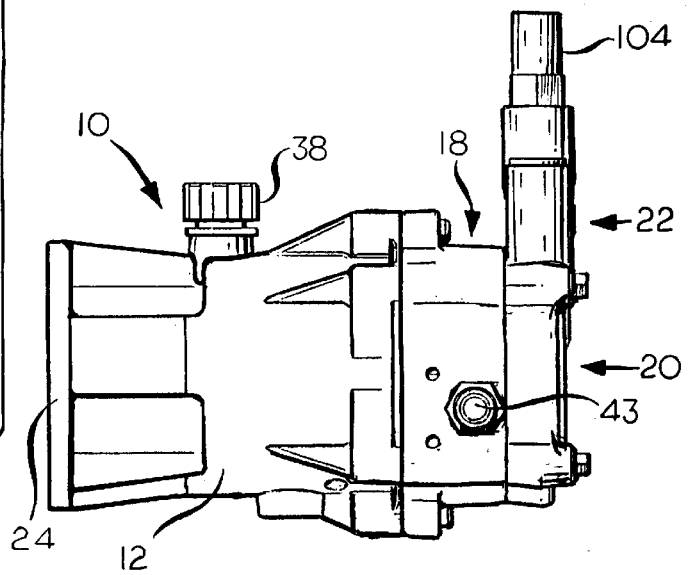

PUMP FOR A PRESSURE WASHER

BACKGROUND OF THE INVENTION

This invention relates in general to a pressure washer and in particular to a pressure washer for coupling to an engine with a vertical or horizontal drive shaft.

The majority of high pressure washers purchased by consumers are horizontally oriented systems. This is because conventional motors used in high pressure systems must typically be associated with gear reducers or shaft sleeves in order to efficiently operate the pump using a rotating motor drive shaft. This makes the pump system quite long and, therefore, awkward for vertical mounting.

However, small, reliable high pressure vertical shaft pressure washers are gaining popularity among consumers. They are useful for a variety of purposes, such as washing automobiles and home sidings. For example, U.S. Pat. No. 5,653,584 to Mazzucato et al. discloses a vertically oriented high pressure water pump system. The system includes a vertically oriented motor, an intermediate flange and an axial drive water pump. The intermediate flange vertically unites the motor and the high pressure water pump and further includes an axial thrust bearing and a thrust bearing sleeve for coupling the motor drive shaft in the axial drive pump.

U.S. Pat. No. 5,494,414 to Steinhart et al. discloses an apparatus for coupling a vertically oriented internal combustion engine to an axial piston pump for use with pressure washers. Attached to the lower surface of the engines is a circular flange with inwardly extending ribs which supports a pump attachment unit. The pump attachment unit is comprised of a series of concentric annular rings for an oil seal and thrust bearing and for pump attachment. The pump drive shaft slides over and is keyed to the engine drive shaft and has an annular lip for mating with the thrust bearing. The pump wobble plate is bolted to the lower end of the pump drive shaft.

However, the above-mentioned pressure washers are relatively complex in design and expensive to manufacture.

SUMMARY OF THE INVENTION

It is an object of the invention to provide a vertical or horizontal shaft pressure washer that is compatible with standard consumer motors such as internal combustion or electric motors.

It is another object of the invention to provide a vertical or horizontal shaft pressure washer that includes a screw on cam or wobble plate for allowing an oil tube to be mounted to the cam shaft that provides superior lubrication to the upper bearings.

It is yet another object of the invention to provide a vertical or horizontal shaft pressure washer that includes a seal retainer assembly for preventing the leakage of any low pressure water from the system.

To achieve these and other objects, the invention provides a vertical or horizontal shaft pressure washer. The pressure washer includes a cam housing, a rotary shaft assembly, a piston assembly, a journal plate, a head assembly and a valve assembly. The rotary shaft assembly includes a cam shaft having one end operatively coupled to a shaft of an engine or motor. The cam shaft has an opening traversing horizontally therethrough. A co-axially mounted oil tube is partially disposed within a central portion of the cam shaft. The oil tube has an opening traversing the length of the oil tube for allowing oil to travel upwards into the opening of the cam shaft. A cam or wobble plate is screwed on the other end of the cam shaft. A thrust washer is positioned adjacent the cam.

The piston assembly includes a plurality of pistons, preferably three, disposed within the cam housing and in mating contact with the thrust washer. A piston spring cap is disposed around one end of each piston to retain a spring for biasing the piston towards the thrust washer. A seal retainer with a low pressure seal on one end and a high pressure seal on the other end is disposed around the other end of the piston. The seal retainer includes an opening between the low pressure seal and the high pressure seal for allowing fluid to pass through the high pressure seal and to be captured by the low pressure seal for recycling the captured fluid back into the head assembly. Each piston is positioned within openings in the journal plate. The journal plate includes an inlet fitting for providing low pressure inlet fluid, such as water, to the vertical or horizontal shaft pressure washer.

The head assembly is connected to the journal plate which has a plurality, preferably three, castellated towers. Each tower has a channel traversing the length thereof. The valve assembly is mounted in the head assembly and is in fluid communication with the channel. The head assembly, in combination with the valve assembly, includes a low pressure valve assembly with a spring-biased valve that acts as a check valve and allows the inlet fluid to travel only from the journal plate to the channel. Similarly, the valve assembly includes a high pressure valve at the end of the channel that acts as a check valve and allows the fluid to travel only from the channel to the outlet fitting.

The screw on cam allows for a pressed fit oil tube and provides for a robust, easy to assemble, and cost effective design. In addition, the castellated towers, in combination with the seal retainers, provides a configuration that captures and recycles any fluid passing through the high pressure seal.

Various objects and advantages of this invention will become apparent to those skilled in the art from the following detailed description of the preferred embodiment, when read in light of the accompanying drawings.

BRIEF DESCRIPTION OF THE DRAWINGS

FIG. 1 is a perspective view of one side of a vertical shaft pressure washer according to a preferred embodiment of the invention;

FIG. 2 is a side elevational view of the opposite side of the vertical shaft pressure washer of FIG. 1;

FIG. 7 is an exploded perspective view of the seal retainer assembly.

DETAILED DESCRIPTION OF THE PREFERRED EMBODIMENT

Figure 3A:
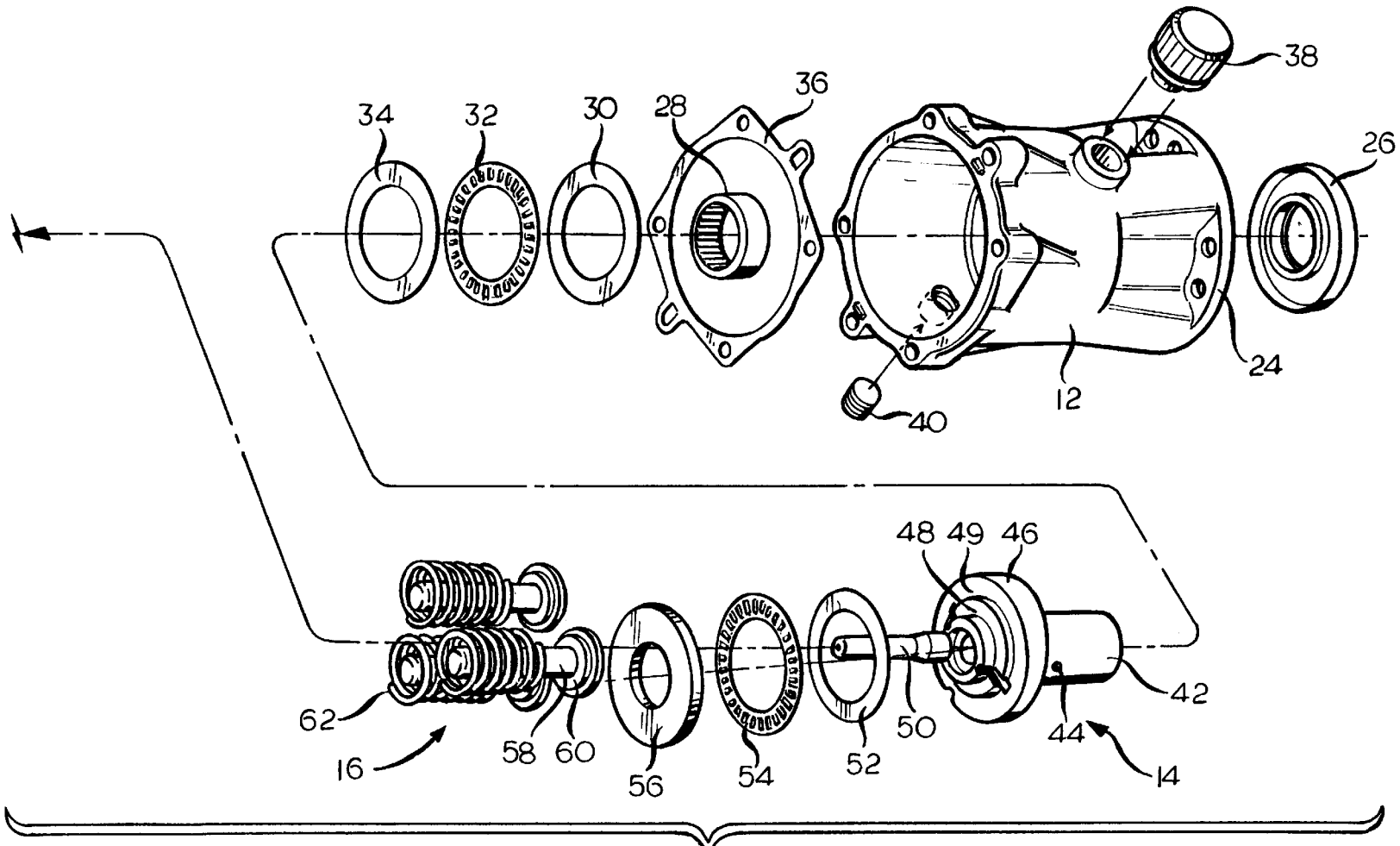
FIGS. 3A and 3B are an exploded perspective view of the vertical shaft pressure washer according to a preferred embodiment of the invention.
Figure 3B:
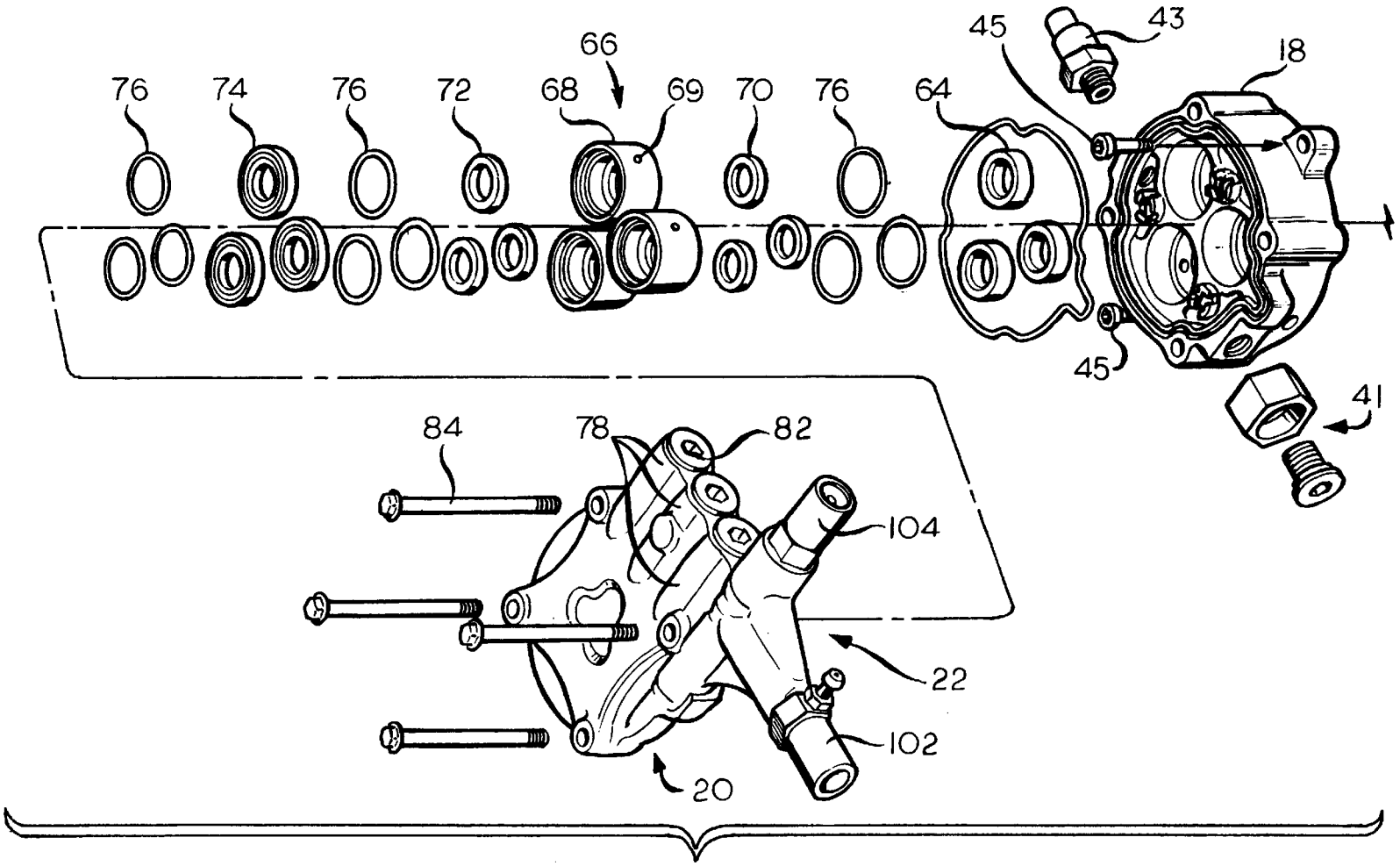

Referring now to the drawings, there is illustrated in FIGS. 1, 2, 3A and 3B a pressure washer, shown generally at 10, according to a preferred embodiment of the invention. In general, the pressure washer 10 includes a cam housing 12, a rotary shaft assembly 14 disposed within the cam housing 12, a piston assembly 16 disposed within the cam housing 12, a journal plate 18 attached to the cam housing 12, a head assembly attached to the journal plate 18, and a valve assembly 22 integrally formed with the head assembly 20. The cam housing 12, the journal plate 18, the head assembly 20, and the valve assembly are preferably made of aluminum. However, any other well-known lightweight, waterproof material may be used, such as plastic, fiberglass, brass, stainless steel, and the like.

The cam housing 12 includes a flange 24 at one end with a plurality of openings for mounting the cam housing 12 to a conventional engine or motor (not shown) using well-known means, such as threaded fasteners. It should be understood that the engine may be any type engine capable of rotating the rotary shaft assembly 14, such as an internal combustion engine or an electric motor. An oil shaft seal 26 is press fit within a recess formed in the cam housing 12 to retain lubricant therein. The oil shaft seal 26 is generally U-shaped in cross section, having an inside axially extending lip and an outside axially extending lip. A needle bearing 28 is also press fit within a recess formed in the cam housing 12. The needle bearing 28 is provided to rotatably support the rotary shaft assembly 14 within the cam housing 12. A pair of annular thrust washers 30 and 34 and an annular thrust bearing 32 are disposed concentrically about a portion of the rotary shaft assembly 14 adjacent to an axially facing surface formed on the cam housing 12. The thrust washers 30 and 34 are positioned on either side of the thrust bearing 32 and are provided for a purpose that will be explained below.

The rotary shaft assembly 14 includes a cylindrical cam shaft 42 having an upper portion that is rotatably supported within the radial needle bearing 28, as described above. A key 42*a*, such as a slot, is formed in the upper portion of the cam shaft to facilitate the connection of the cam shaft 42 to an engine shaft (shown in phantom). The cam shaft 42 further includes a lower portion having a threaded outer surface 42*b*. An opening 44 is formed through the lower portion of the cam shaft 42 to provide fluid communication therethrough. The opening 44 includes a pair of perpendicularly oriented passages 44*a* that extend radially outwardly to the outer surface of the cam shaft 42. The purpose of the opening 44 will be described in detail below.

Figure 4:
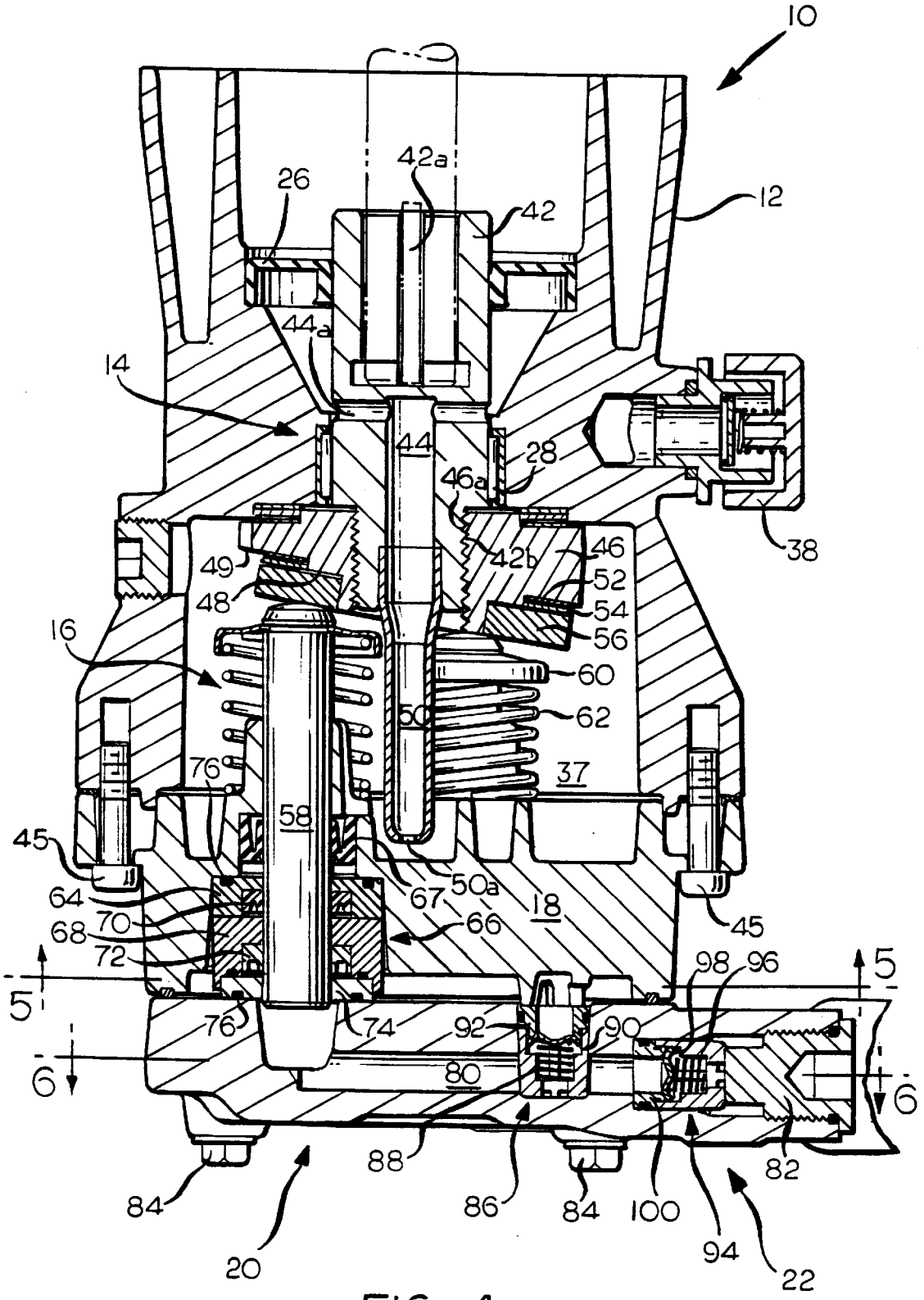
FIG. 4 is a cross-sectional view of the vertical shaft pressure washer taken along line 4—4 of FIG. 1.

As best seen in FIG. 4, the rotary shaft assembly 14 also includes an annular cam or wobble plate 46 having a threaded interior surface 46*a*. The cam 46 is as mounted on the cam shaft 42 by screwing the threaded interior surface 46*a* of the cam 46 onto the threaded outer surface 42*b* of the cam shaft 42. The screw-on connection between the cam shaft 42 and the cam 46 provides a very robust shaft design, ease of assembly, cost effectiveness, and (as will be explained further below) facilitates lubrication of the needle bearing 28. The upper end of the cam 46 is disposed adjacent to and abuts the thrust washers and 34 and the thrust bearing 32 during use. The lower end of the cam 46 has inner and outer ledges 48 and 49 formed thereon. A thrust washer 52 and thrust bearing 54 are disposed adjacent to the outer ledge 49 of the cam 46. A thrust washer 56 is disposed adjacent to the inner ledge 48 and the thrust bearing 54 of the cam 46.

An oil tube 50 is press fit with the lower end of the opening 44 formed through the cam shaft 42. The oil tube 50 includes an upper end having an inner diameter that is slightly larger than the inner diameter of a lower end thereof. Thus, the inner surface of the oil tube 50 defines a transition portion that tapers (preferably at an angle of approximately ten degrees) from the smaller diameter lower portion toward the larger diameter upper portion. The lowermost end of the oil tube 50 has an opening 50*a* formed therethrough to allow lubricant to enter therein.

A gasket 36 may be disposed between the cam housing 12 and the journal plate 18 to provide a seal therebetween. The lower portion of the cam housing 12 forms a sump 37 for gathering lubricant therein. The cam housing 12 may also include a vent cap 38 for providing a means for relieving any excess oil pressure that may occur within the cam housing 12 during operation. A plug 40 may be used to allow the addition or removal of oil to the cam housing 12. As shown in FIG. 4, the lowermost end of the oil tube 50 extends downwardly into the sump 37.

Figure 5:
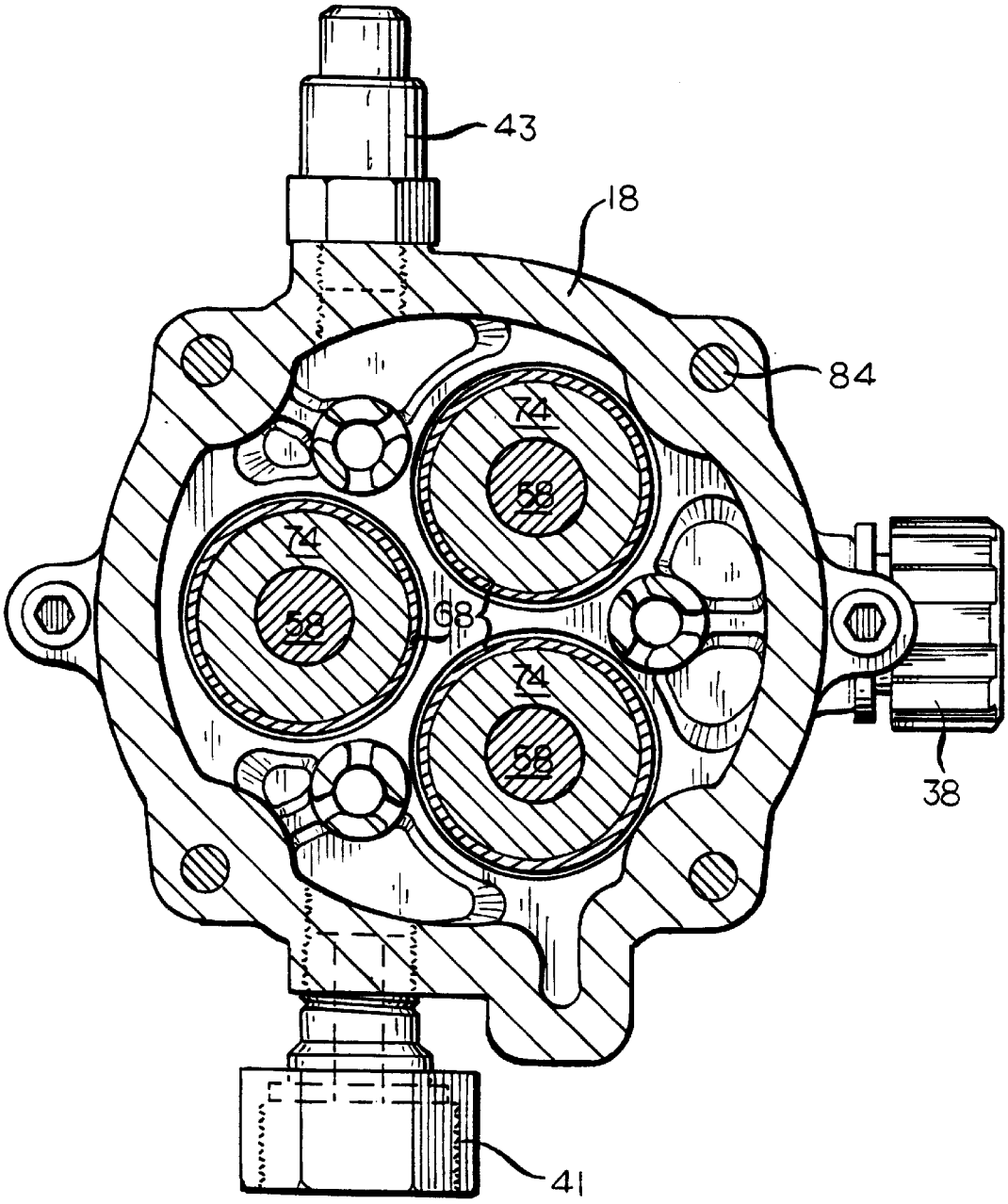
FIG. 5 is a cross-sectional view of the vertical shaft pressure washer taken along line 5—5 of FIG. 4.
Figure 6:
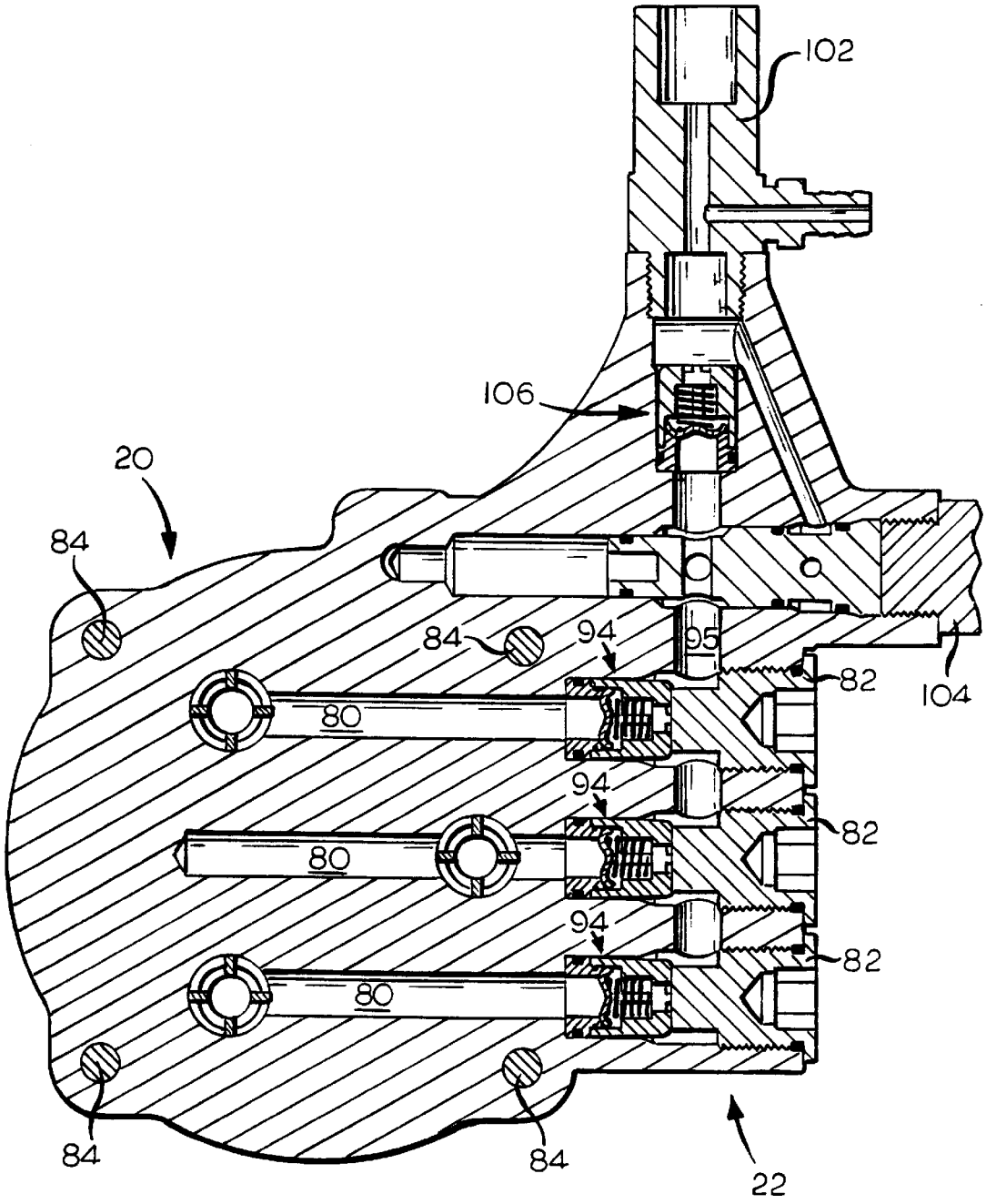
FIG. 6 is a cross-sectional view of the vertical shaft pressure washer taken along line 6—6 of FIG. 4.

As best shown in FIG. 5, the journal plate 18 defines an interior cavity. An inlet fitting 41 is provided on the journal plate 18 to connect the pressure washer to a low pressure, inlet water source, such as a garden hose. During operation, the interior cavity of the journal plate 18 is substantially filled with the low pressure, inlet water supplied through the inlet fitting 41. A thermal overload sensor 43 may be connected to the journal plate 18 to provide an indication of the operating temperature within the pressure washer 10. The thermal overload sensor 43 may be used to control the operation of the engine in response to such operating temperature. A plurality of bolts 45 fixedly attach the journal plate 18 to the cam housing 12.

As seen in FIG. 4, the lower portion of the rotary shaft assembly 14 extends within the oil sump 37 of the cam housing 12. As the cam shaft 42 is rotatably driven by the engine, the cam 46 and the oil tube 50 also rotate in the same direction. This rotation causes the oil in the oil sump 37 to travel upward by centrifugal force through the hollow center of the oil tube 50 and into the central opening 44 formed through the cam shaft 42. The oil travels further upwardly through the central opening 44 formed through the cam shaft 42 and outwardly through radially extending passages 44*a* into the upper portion cam housing 12. As a result, lubrication is automatically provided to the radial needle bearing 28 in the upper portion of the cam housing 12, regardless of whether the pressure washer is oriented horizontally or vertically. This important feature provides a positive flow of oil and superior lubrication even when the vertical shaft pressure washer is in a horizontal position.

As mentioned above, the pressure washer 10 also includes a piston assembly 16. The piston assembly 16 includes a plurality of pistons 58, preferably three pistons in the preferred embodiment of the invention. A piston spring cap 60 is disposed around the upper end of each piston 58. A piston spring 62 is also disposed concentrically about each piston 58. The ends of the piston spring 62 react against the piston spring cap 60 and the journal plate 18 to urge the piston 58 in an upward direction into abutment with the thrust washer 56. Thus, as the cam 46 rotates, each of the pistons 58 reciprocates upwardly and downwardly within the cam housing 12 and the journal plate 18.

As best seen in FIGS. 4 and 5, the lower end of each piston 58 is received within a stepped opening formed through the journal plate 18. A piston oil seal 64 is disposed within a first portion of the opening. The piston oil seal 64 seals against the outer surface of the piston 58 to prevent oil in the oil sump 37 from passing downwardly through the journal plate 18 into the head assembly 20 and the valve assembly 22.

Referring now to FIGS. 4, 5 and 7, a seal retainer assembly 66 is also disposed within the stepped opening formed through the journal plate 18. As best shown in FIG. 7, the seal retainer assembly 66 includes a generally cylindrically-shaped seal retainer 68 that has a reduced diameter central portion. The seal retainer assembly 66 also has a radially extending opening 69 formed through the central portion thereof. As described below, the opening 69 allows the passage of intake water through the seal retainer 68 to allow the recycling of intake water. A low pressure or leak back seal 70 is disposed within the seal retainer 68 at one end of the reduced diameter central portion thereof. The low pressure seal 70 prevents the flow of water in the upward direction, that is, through the journal plate 18 and into the oil sump 37. A high pressure seal 72 is disposed within the seal retainer 68 at the other end of the reduced diameter central portion thereof to prevent high pressure fluid from passing through the high pressure seal 72 toward the low pressure seal 70. A seal washer 74 is disposed between the high pressure seal 72 and the head assembly 20. The seal washer 74 provides a seal between the intake water and the high pressure outlet water. O-rings 76 may be positioned between the seal washer 74 and the head assembly 20, between the seal washer 74 and the high pressure seal 72, and between the low pressure seal 70 and the piston oil seal 64. The low pressure seal 70, the high pressure seal 72, the seal washer 74, and the O-rings 76 may be made of TEFLON® with the piston 58 made of 440 C stainless steel heat treated to 56 RC (Rockwell C hardness scale) to 62 RC to provide superior lifetime.

The opening 69 in the seal retainer 68 is located between the high pressure seal 72 and the low pressure seal 70, which allows intake water to enter. This feature allows the low pressure seal 70 to capture the water and allows for the recycling of any water that passes through the high pressure seal 72 such that the user does not see any leaks.

Referring now to FIGS. 1, 3A, 3B and 6, the head assembly 20, in combination with the valve assembly 22, provides for a castellated tower configuration. In the preferred embodiment of the invention, the head assembly 20 includes three towers 78, one for each piston 58. Each tower 78 has a hollow interior forming a fluid channel 80 traversing the length thereof. Each tower 78 also includes a valve plug 82 threaded onto the end of the tower 78 for allowing access to the tower 78. The head assembly 20 is connected to the journal plate 18 using a plurality of bolts 84, preferably four bolts located at each corner of the head assembly 20. The bolts 84 are sufficiently long to pass through openings in the journal plate 18 into threaded opening formed in the cam housing 12. In this manner the head assembly 20, the journal plate 18, and the cam housing 12 are secured together as a unit.

A low pressure inlet valve assembly 86 provides one-way fluid communication from the interior cavity formed in the journal plate 18 to the fluid channel 80 in the tower 78. Thus, low pressure water can flow only from the inlet fitting 41 into the fluid channel 80. The inlet valve assembly 86 includes a valve spring 88 that biases a valve poppet 90 against a valve seat 92. During an intake stroke of the piston 58 (i.e., upward movement of the piston 58 in FIG. 4), the pressure of the inlet water contained within the interior cavity of the journal plate 18 is greater than the pressure of the water contained in the fluid channel 80. As a result, the valve poppet 90 is moved off of the valve seat 92 to allow the inlet water to pass through the inlet valve assembly 86 into the fluid channel 80 of the tower 78. During the power stroke of the piston 58 (i.e., downward movement of the piston 58 in FIG. 4), the inlet valve assembly 86 acts as a check valve and prevents the high pressure water in the fluid channel 80 from flowing back through the inlet valve assembly 86 and into the journal plate 18.

A high pressure outlet valve assembly 94 is disposed at one end of the channel 80 of each tower 78. Similar to the inlet valve assembly 86, the outlet valve assembly 94 includes a valve spring 96 for biasing a valve poppet 98 against a valve seat 100. During the power stroke of the piston 58, the water contained within the fluid channel 80 is increased so as to raise the valve poppet 98 off the valve seat 100 to allow the outlet water or fluid to pass through the outlet valve assembly 94 into an outlet passage 95 (see FIG. 6). The pressurized water passes from the outlet passage 95 through an outlet check valve 106 and into an outlet fitting 102. During the intake stroke of the piston 58, the outlet valve assembly 94 acts as a check valve and prevents the high pressure water in the outlet passage 95 from flowing back through the outlet valve assembly 94 and into the channel 80. In addition, the outlet check valve 106 prevents water in the outlet fitting 102 from flowing back through the outlet check valve 106 and into the outlet passage 95. The valve assembly 22 may also include a relief valve 104 for relieving any excess pressure that may occur within the outlet fitting 102.

As mentioned above, the feature of the screw-on cam 46 and the oil tube 50 provides a pressure washer structure that is robust, easy to assemble, and cost effective. In addition, the castellated tower configuration of the head assembly, in combination with the valve assembly 22, provides a path for intake water to enter and exit the vertical shaft pressure washer 10. Further, the opening 69 in the seal retainer 68 between the low pressure seal 70 and the high pressure seal 72 captures any intake water or fluid that passes through the high pressure seal 72 and recycles it so that the user does not see any leaks in the vertical shaft pressure washer 10.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A pump for a pressure washer, comprising:

a cam housing;

a rotary shaft assembly disposed within said cam housing;

a piston assembly disposed within said cam housing;

a journal plate attached to said cam housing;

a head assembly attached to said journal plate; and a valve assembly mounted on said head assembly, wherein said rotary shaft assembly comprises a cam shaft having a threaded outer surface and a cam having a threaded interior surface, said cam being mounted to said cam shaft by screwing the threaded interior surface of said cam onto the threaded outer surface of said cam shaft.

2. The pump according to claim 1, wherein said rotary shaft assembly further comprises a co-axially mounted oil tube partially disposed within a central portion of said cam shaft and a thrust washer positioned adjacent said cam.

3. The pump according to claim 1, wherein said piston assembly comprises a plurality of pistons for engaging a thrust washer of said rotary shaft assembly, each piston including a piston spring cap attached to one end thereof, a spring engaging said piston spring cap, and a seal retainer assembly having a low pressure seal at one end and a high pressure seal at the other end.

4. The pump according to claim 3, wherein said seal retainer assembly includes an opening between said low pressure seal and said high pressure seal for allowing fluid to pass through said high pressure seal and to be captured by said low pressure seal for recycling such fluid back into said head assembly.

5. The pump according to claim 3, wherein said plurality of pistons comprises three pistons.

6. The pump according to claim 3, wherein said journal plate includes a plurality of openings for receiving said plurality of pistons and an inlet fitting for connecting to a supply of fluid.

7. The pump according to claim 3, wherein said head assembly includes a plurality of openings for receiving said plurality of pistons.

8. The pump according to claim 1, wherein said head assembly is formed of aluminum material.

9. The pump according to claim 1, wherein said head assembly includes a plurality of castellated towers.

10. The pump according to claim 9, wherein each tower includes a low pressure valve assembly in fluid communication with said journal plate and a high pressure valve assembly in fluid communication with an outlet fitting.

11. The pump according to claim 10, wherein said low pressure valve assembly includes a valve for allowing fluid to travel from said journal plate to said head assembly.

12. The pump according to claim 10, wherein said high pressure valve assembly includes a valve for allowing fluid to travel from said head assembly to the outlet fitting.

13. The pump according to claim 3, wherein each piston is formed of 440 C stainless steel having a hardness of between 56 RC and 62 RC, and wherein said high pressure seal is made of TEFLON® material.

14. The pump according to claim 1, wherein said cam housing includes a first portion and a second portion forming an oil sump, and wherein said rotary shaft assembly includes a cam shaft located in the first portion of said cam housing operatively coupled to a motor-driven shaft, and a co-axially mounted oil tube located in the second portion having one end partially-disposed with a central portion of said cam shaft, and wherein rotation of the cam shaft causes rotation of the oil tube, thereby causing oil in the oil sump of the second portion of said cam housing to travel through an opening in the oil tube and out of an opening in the cam shaft, thereby providing lubrication to the second portion of said cam housing.

15. The pump according to claim 1, wherein said valve assembly includes a low pressure inlet valve assembly for providing one-way fluid communication from said journal plate to said head assembly, and wherein said valve assembly further includes a high pressure outlet valve assembly for providing one-way fluid communication from said head assembly to an outlet of said pump.

16. The pump according to claim 1, wherein said piston assembly includes a plurality of pistons, each piston having one end in mating contact with said rotary shaft assembly and a seal retainer assembly disposed around the other end, the seal retainer assembly including a low pressure seal at one end and a high pressure seal at the other end and a seal retainer having an opening disposed therebetween, and wherein fluid passing through the high pressure seal passes through the opening in the seal retainer and is captured by the low pressure seal for recycling such fluid into said head assembly.

* * * * *